US010993491B2

(12) United States Patent
Xia et al.

(10) Patent No.: US 10,993,491 B2
(45) Date of Patent: May 4, 2021

(54) WATER-ABSORBENT QUICK-DRYING KNITTED FABRIC AND APPLICATION THEREOF

(71) Applicants: Toray Fibers & Textiles Research Laboratories (China) Co., Ltd., Jiangsu (CN); TORAY SAKAI WEAVING & DYEING (NANTONG) CO., LTD., Jiangsu (CN)

(72) Inventors: Hongxia Xia, Jiangsu (CN); Kenji Akizuki, Jiangsu (CN); Chunyan Huang, Jiangsu (CN); Jianlin Lu, Jiangsu (CN); Naoki Oda, Jiangsu (CN)

(73) Assignees: TORAY FIBERS & TEXTILES RESEARCH LABORATORIES (CHINA) CO., LTD., Jiangsu (CN); TORAY SAKAI WEAVING & DYEING (NANTONG) CO., LTD., Jiangsu (CN)

( * ) Notice: Subject to any disclaimer, the term of this patent is extended or adjusted under 35 U.S.C. 154(b) by 722 days.

(21) Appl. No.: 15/555,137

(22) PCT Filed: Mar. 3, 2016

(86) PCT No.: PCT/CN2016/075442
§ 371 (c)(1),
(2) Date: Jan. 12, 2018

(87) PCT Pub. No.: WO2016/138868
PCT Pub. Date: Sep. 9, 2016

(65) Prior Publication Data

US 2018/0116318 A1 May 3, 2018

(30) Foreign Application Priority Data

Mar. 4, 2015 (CN) ..... 201510096595.X

(51) Int. Cl.
*D04B 1/16* (2006.01)
*A41D 31/12* (2019.01)
(Continued)

(52) U.S. Cl.
CPC ..... *A41D 31/185* (2019.02); *A41D 13/00* (2013.01); *A41D 13/002* (2013.01); *A41D 31/12* (2019.02);
(Continued)

(58) Field of Classification Search
CPC . D04B 1/10; D04B 1/102; D04B 1/12; D04B 1/24
See application file for complete search history.

(56) References Cited

U.S. PATENT DOCUMENTS

2005/0202741 A1 9/2005 Onodera et al.
2013/0209743 A1 8/2013 Deguchi et al.

FOREIGN PATENT DOCUMENTS

CN 1675421 A 9/2005
CN 201588054 U 9/2010
(Continued)

OTHER PUBLICATIONS

International Search Report and Written Opinion for International Application No. PCT/CN2016/075442, dated Jun. 6, 2016—6 Pages.
(Continued)

*Primary Examiner* — Jenna L Johnson
(74) *Attorney, Agent, or Firm* — RatnerPrestia

(57) ABSTRACT

The present invention discloses a water-absorbent quick-drying knitted fabric and application thereof. The fabric is a single-sided knitted fabric, the reverse side having a concave-convex structure, the height of the convex parts of the concave-convex structure being 40-150 μm, and the fiber forming the convex parts being a polyester elastic fiber. The present knitted fabric has excellent water-absorbing and
(Continued)

Figure 1:
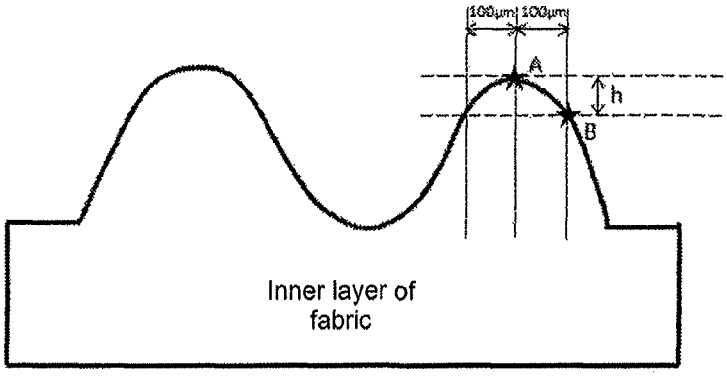

quick-drying properties, improving the comfort of wear and being suitable for use in manufacturing T-shirts, polo shirts, and the like.

6 Claims, 1 Drawing Sheet

(51) Int. Cl.

| | |
|---|---|
| ***D04B 1/10*** | (2006.01) |
| ***D04B 1/18*** | (2006.01) |
| ***D04B 1/12*** | (2006.01) |
| ***A41D 31/18*** | (2019.01) |
| ***A41D 13/00*** | (2006.01) |
| ***A41D 13/002*** | (2006.01) |
| ***D04B 1/24*** | (2006.01) |

(52) U.S. Cl.
CPC ..... *A41D 31/125* (2019.02); *D04B 1/102* (2013.01); *D04B 1/16* (2013.01); *D04B 1/18* (2013.01); *D04B 1/246* (2013.01); *D04B 1/12* (2013.01); *D10B 2403/02* (2013.01); *D10B 2403/033* (2013.01)

(56) References Cited

FOREIGN PATENT DOCUMENTS

| | | | |
|---|---|---|---|
| CN | 102134776 | A | 7/2011 |
| CN | 103122549 | A | 5/2013 |
| CN | 103628239 | A | 3/2014 |
| CN | 103154344 | A | 10/2014 |
| CN | 104178899 | A | 12/2014 |
| EP | 2492390 | A1 | 8/2012 |
| EP | 2628833 | A1 | 8/2013 |
| JP | 61174401 | A | 8/1986 |
| JP | 10131000 | A | 5/1998 |
| JP | 2001303402 | A | 10/2001 |
| JP | 2006249595 | A | 9/2006 |
| JP | 2007327156 | A | 12/2007 |
| JP | 2011226026 | A | 11/2011 |
| WO | 02053362 | A1 | 7/2002 |
| WO | 02084002 | A1 | 10/2002 |

OTHER PUBLICATIONS

Extended European Search Report for European Application No. 16 758 483.8, dated Oct. 24, 2018, 9 pages.
Chinese Office Action for Chinese Application No. 201680010638.0, dated Aug. 27, 2018, with translation, 10 pages.

WATER-ABSORBENT QUICK-DRYING KNITTED FABRIC AND APPLICATION THEREOF

CROSS-REFERENCE TO RELATED APPLICATION

This is the national phase of International Application No. PCT/CN2016/075442, filed Mar. 3, 2016, which claims priority to Chinese Application No. 201510096595.X, filed Mar. 4, 2015. The disclosure of each of these applications is incorporated herein by reference in its entirety for all purposes.

TECHNICAL FIELD

The present invention relates to a water-absorbent quick-drying knitted fabric and application thereof, in particular to a water-absorbent quick-drying single-sided knitted fabric and application thereof.

BACKGROUND

In recent years, with the continuous improvement of living standards, the functional demands for sportswear worn with body contact, or for T-shirts and POLO shirts worn in spring and summer, and so on are also becoming increasingly higher and higher. This is because it is prone for people to sweat a lot, when they sport or when the outdoor temperature is relatively high in spring and summer. If the sweat cannot be timely absorbed, evaporated, or diffused by the fabric, the swollen fiber due to the moisture absorption may block the void positions of the fabric. It makes the skin in an anaerobic environment, and thus makes people feel very sultry and reduces the comfort feeling.

At present, there are a lot of water-absorbent quick-drying fabrics on the market. Most of them are double sided circular knitted fabrics. For example, Chinese patent application CN201210296683.0 discloses a double sided knitted fabric. Its surface layer is the fine denier polyester yarn, and its inner layer is the multi-leaf profile polyester yarn partially or wholly. By the multi-leaf profile polyester yarn of the inner layer, the reverse side provides water-absorbent effect, and then, the moisture absorbed by the inner layer is transferred to the surface through the fine denier polyester yarn in the surface layer. Thus the purpose of the sweat absorption and perspiration is achieved. But such fabric has a relatively flat inner layer so that the fabric is easy to adhere to the skin and to affect the dry and comfortable feeling of the skin after absorbing sweat. In addition, after the sweat absorption, the inner layer yarns cannot timely diffuse all of water content to the surface, resulting in swelling phenomena so that the holes of the fabric are blocked. Thus, it makes the skin in an anaerobic environment, and thus makes people feel very sultry, and reduces the comfort feeling.

For another example, China patent application CN201180049196.8 discloses a multilayer structure knitted grey fabric, wherein a certain amount of cellulose-type long fibers are provided near the inner surface (skin side) of the grey fabric. It solves the problem of sultry feeling due to insensible perspiration or a small amount of sweat, and the sticky, wet, cool feeling and other problems due to the profuse sweating caused by sports, etc. However, in fact, even if the skin contact surfaces are of the concave-convex structure, because the cellulose-type long fibers with excellent water-absorbent and moisture absorption performance are used, a part of the water will still remain in the skin contact surface, so that the wet feeling and other problems still cannot be completely solved. In addition, since a double jersey has smaller fiber gap compared with the single jersey, the time needed for water to be transferred to the surface is relatively longer, and the quick-drying property is poorer.

For another example, Japanese Laid Open Patent Application H10-131000 discloses a kind of water-absorbing and quick-drying knitted fabric, wherein a certain concave-convex height difference is provided on the reverse side of this fabric. By using fine denier viscose filament or viscose/polyester combined filament yarn in the concave part and using polyester filament in the convex part and the surface, the problems such as sultry feeling and skin touch feeling are solved. However, since non-elastic polyester filaments are used for the convex part of the reverse side, the yarn shrinkage is poor, so that the concave-convex height difference is not enough even in case that concave-convex structure is formed on the reverse side. In the case of a lot of sweat, the moisture is still difficult to be immediately diffused to the surface, which adversely affect the quick-drying property.

For another example, Japanese Laid Open Patent Application H2011-226026 discloses a kind of knitted fabric for clothing material, wherein two kinds of yarns are used in its reverse side, i.e., hydrophobic synthetic fiber with the water repellency for the convex part, and the hydrophobic synthetic fiber without the water repellency for other parts. Although such yarn combination, adopted on the reverse side of the fabric, improves the sticky feeling more or less in case of sweating a lot, the water-absorbent property of the reverse side is greatly reduced because the water repellency yarn is used in the convex part. Moreover, the function of moisture diffusion to the surface also declines accordingly, so that the overall quick-drying of the clothing material deteriorates, and that the sultry feeling when wearing is still existing.

Therefore, the quick drying property of water-absorbent quick-drying fabric in the prior art needs further improvement and perfection.

SUMMARY OF THE INVENTION

The purpose of the present invention is to provide a single-sided knitted fabric with excellent water-absorbent quick-drying property, which is suitable for making T-shirts or POLO shirts, etc.

In order to achieve the above purposes, the present invention consists of the following:

(1) A single-sided knitted fabric, the reverse side (inner side) having a concave-convex structure, the height (h) of the convex parts of the concave-convex structure being 40-150 μm, the fiber forming the convex parts being a polyester elastic fiber.

(2) In the concave-convex structure as described in the aforementioned (1), the distance between adjacent convex parts is 50~400 μm.

(3) The polyester elastic fiber as described in the aforementioned (1) is selected from mono-component fiber of polybutylene terephthalate (PBT), polytrimethylene terephthalate (PTT), or a composite fiber thereof with polyethylene terephthalate (PET), or a composite fiber of two kinds of polyethylene terephthalate (PET) with viscosity difference.

(4) In the kinitted fabric as described in the aforementioned (1), the yarn, cross knitted with polyester elastic fiber includes at least ordinary polyethylene terephthalate (PET) fiber.

(5) The gram weight of any one of knitted fabric as described in the aforementioned (1)~(4) is 50~250 g/m$^2$.

(6) The ratio of outer/inner water retention rate of any one of knitted fabric as described in the aforementioned (1)~(4) is 5.0 or more.

(7) T-shirts or POLO shirts which are made with the knitted fabric described in (1).

The present invention is obtained by combining unique yarn structures with specific structures. The obtained fabric is light and thin, has excellent water-absorbing and quick-drying properties, enhanced wearing comfort, and it is suitable for use in manufacturing T-shirts, polo shirts, and the like.

DESCRIPTIONS OF FIGURES (1) FIG. 1 is the schematic diagram of the convex height measurement, wherein, A shows the peak point of the convex, B shows the lowest point, and h is the convex height.

Figure 2:
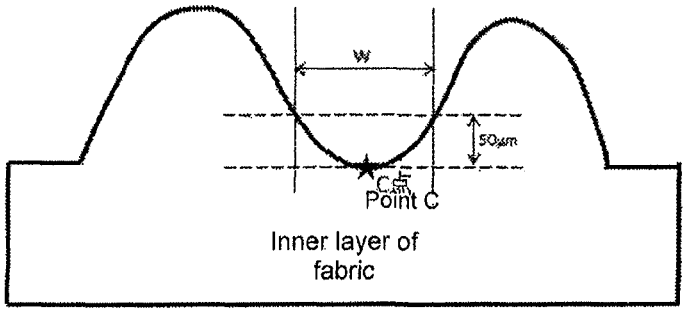

(2) FIG. 2 is the schematic diagram of measuring the distance between adjacent convexs, wherein, C shows the lowest point which is located between the adjacent convexs, and w is the distance of two adjacent convexs.

DESCRIPTION OF EMBODIMENTS

Considering the lightness of wearing; single sided structure is applied for the water-absorbent quick-drying fabric of the present invention. Compared with the double sided knitted fabric formed by yarns with the same fineness, the single sided structure has lower gram weight, and is more favourable for sports. Moreover, to obtain more excellent water-absorbent quick-drying effect than double sided knitted fabric, a concave-convex structure is provided on the reverse side of the single-sided knitted fabric in the present invention. The fabric contacts with human body only in part (point contact), and the gap between fibers is large, which consequently increases the circulation space for evaporation of the sweat liquid (water vapor). Even though there is a large amount of sweat, the water content can be diffused to the fabric surface rapidly and timely, and the dry and clear feeling inside the clothes can be kept.

A concave convex structure with proper convex height can effectively prevent sweat (water vapor) from remaining on the reverse side of the fabric and thus, the convex height in the length direction of the reverse side of the fabric in the present invention is 40~150 μm, preferably 40~100 μm. If the convex height is less than 40 μm, after human body sweats a lot, the reverse side of the fabric is too smooth and prone to adhere to the skin, resulting in the discomfort. Meanwhile, the sweat (water vapor) absorbed by such side is difficult to be timely led to the surface. The water retaining amount is increased, and the yarns become swelling, and the original knitted holes in the fabric become smaller. It causes skin in the anaerobic environment during continuous sports, resulting in sultry feeling. The fabric in the present invention is of the single sided structure. Consequently, the higher the convex height is, the larger the gaps between fibers become. so that sweat will be quickly transferred to the fiber surface during continuous sport activity, and the dry and clear feeling of the skin-contacting surface is always maintained. On the other hand, the convex height cannot be too large. When it exceeds 150 μm, the convex parts may irritate skin during wearing, resulting in rough and the itch feeling, which is adverse to sports.

In the present invention, the fiber forming the convex parts of the reverse side of the fabric is very critical from two major points discussed below. Firstly, if non-polyester fibers such as cellulose fiber or nylon fiber are used, a large amount of water content can be absorbed on the reverse side of the fabric, because these fibers have relatively superior hygroscopicity. In such case, a part of the water content is difficult to be diffused to the surface timely, which results in the increase of the water retaining amount in the reverse side, causing the decrease of wearing comfort and the sultry feeling. On the other hand, if the non-elastic polyester fibers are used, the shrinkage degree of the yarn in the processing process after knitting is too small to form a convex with a height of 40~150 μm and the quick-drying effect is not significant. Therefore, as the fiber at convex parts of the reverse side in the fabric of the present invention, polyester elastic fibers are used.

In addition, the distance between adjacent convex parts in the concave-convex structure is also very important. It largely affects the water absorption and rapid transmissibility in the reverse side of the fabric. Therefore, in the length direction of the reverse side of the fabric in the present invention, the distance between adjacent convex parts is preferably 50~400 μm, more preferably 100~300 μm. In case of the above ranges, the water-absorbent—rapid transmission—dry and clear effects of the fabric can become best. If the distance between adjacent convex parts is less than 50 μm, the moisture transmission from the reverse side to the surface might be prevented. It increases the wet feeling of the reverse side, and reduces the wearing comfort. If the distance between adjacent convex parts is more than 400 μm, although the moisture is easily diffused to the fabric surface, the probability of the convex parts in the reverse side contacting the skin will decrease simultaneously, so that the skin may directly contact with the fabric surface. Because the moisture and sweat are concentrated on the surface, people will feel sticky and sultry. Especially when sweating a lot during the sport activities, the sticky feeling, wet feeling, and cold feeling will become more serious.

The polyester elastic fiber used in the present invention is preferably the elastic fiber with a contract recovery rate (CR value) of 30~70%. The polyester elastic fiber with a CR value within the range, has good crimp contraction property, and the fabric formed by such fiber has convex with appropriate height in the reverse side. Even sweating a lot, no sultry feeling occurs, and the dry and clear feeling when contacting with the skin is more superior. The CR value is more preferably 40~60%.

There is no special restriction for the polyester elastic fiber types used in the present invention. It can be the single-component elastic fiber, the two-component juxtaposed elastic fiber, or the high elastic false twist processing yarn, and the like. It is preferably PBT, PTT, PBT/PET, PTT/PET, high viscosity PET/low viscosity PET. There is no special restriction for its form. It can be fully drawn yarn (FDY) or false twist yarn DTY.

The fineness of polyester elastic fiber used in the present invention is preferably 30~150 danier (D), more preferably 40~100D, so as to guarantee the gram weight and the soft hand feeling of the fabric.

The fabric in the present invention is of the single sided structure. The yarns cross knitted with polyester elastic fiber appear on the fabric surface and the concave parts of the reverse side. Although there is no special restriction on the fiber types of the cross knitted yarns, if only cotton, viscose, nylon, and other high moisture-absorbing fibers are used, it may be difficult to guarantee that the sweat (water vapor) can be led to the surface maximally and timely, and consequently guarantee the maintenance of the superior dry and clear feeling of the skin-contacting surface. Therefore, the cross knitted yarns preferably at least include ordinary PET (non-modified PET) fiber. Its cross section can be round or profiled. In case of profiled cross section, it can be cross, triangle, star, cross/round, and so on. In addition to the above ordinary PET fiber, the cross knitted yarns can also contain spandex (PU), cotton, viscose, nylon, etc, for not only ensuring the superior water-absorbent quick-drying property, but also imparting more functions to the fabric.

The cross knitted yarns in the present invention preferably are 100% ordinary PET (non-modified PET) fibers. Namely, the fabric in the present invention is preferably made of 100% polyester fiber. This can ensure that the fabric has a superior ratio of outer/inner water retention rate.

When the above yarns cross knitted with the polyester elastic fiber are short fibers, the yarn fineness thereof is not particularly limited. The commercially available yarns can be used. However, when short fiber is used, due to the hairiness of staple yarn surface formed by short fiber, water vapor may be absorbed, and the diffusion of moisture on the surface may be hindered. Long fiber is preferred since the diffusion of moisture will not be hindered due to smooth surfaces possessed by long fiber. In order to guarantee the soft hand feeling, excellent water-absorbent quick-drying property, and snaging property, the monofilament fineness of the long fiber used is preferably 0.3~2.5D, more preferably 0.4~2.0D.

The structure used in the present invention is preferably changing pique, changing pique stripes, changing pique stripes with interlaced thickness, etc. The changing pique structure is produced by the composite of the looping, tucking, and floating wire. Convex parts with suitable height are obtained based on the traditional pique structure in combination with suitable tuck stitch. The changing pique stripes and the stripes with interlaced thickness can be obtained on the basis of the changing pique in combination with different kinds of yarns (i.e., yarns different in raw materials, gloss, or cross section). However, the structure is not limited to the above, any single sided structure which can form the concave-convex structure in the reverse side of a knitted grey fabric can be used.

The production method of the water-absorbent quick-drying knitted fabric in the present invention is as below. In the 24 G~36 G single-sided round knitting machine, at least polyester elastic fiber and other fibers are subjected to cross knitting, to provide the knitted grey fabric. Afterwards, the obtained knitted grey fabric is subjected to pretreatment, dyeing, and post-treatment processing, resulting in a product wherein its reverse side has a concave-convex structure, the height of the convex parts of the concave-convex structure is 40-150 μm, and the fiber forming the convex parts is a polyester elastic fiber. For the conditions for the pretreatment, dyeing, and post-treatment processing, conventional conditions are applied. The pretreatment and dyeing can be performed in the same bath or separately. In addition, suitable chemicals can be added to each process as required. For example, refining agents, bleaching agents, and so on can be added during pretreatment. Hydrophilic agents, anti-static agents, neutralization acids, and so on can be added in the post-treatment processing. Preferably, hydrophilic agents are added in the dyeing or post-treatment processing, so as to achieve more excellent water-absorbent quick-drying property. The refining agents, hydrophilic agents, and so on used in the present invention can be the commercially available products. The amount of each chemical is preferably 0.1~20 g/L.

The gram weight of the knitted fabric in the present invention is preferably 50~250 g/m$^2$, depending on different seasons and different usage. More preferably, it is 100~200 g/m$^2$. The light design is especially suitable for sportswear.

For the knitted fabric in the present invention, the water retention rate of its reverse side (inside) is preferably 10% or less, more preferably 5% or less. Its ratio of outer/inner water retention rate is preferably 5.0 or more, and more preferably 5.0-30.0. Its water-absorbent property is preferably 5 seconds or less, and more preferably 2 seconds or less. The greater the ratio of outer/inner water retention rate (ratio value) is, the smaller the inner water retention rate is, and the better the quick drying property of the fabric is. Even in the case of profuse sweating, sweat can also be absorbed rapidly and transferred timely to the surface. The skin-contacting surface is always kept dry and clear, and the comfort and the sport effects of continuous wearing will not be affected.

The knitted fabric of the present invention can be used to produce T-shirt, POLO shirts, and the like for the sport or everyday wearing. It has no special restriction on style. Either long-sleeve style or short-sleeve style is possible.

EXAMPLES

The present invention is further described with the examples and comparative examples as follows. In the examples, the properties are measured according to the following methods.

(1) Height of Convex Parts of the Concave-Convex Structure in the Reverse Side of the Fabric A 20 cm*20 cm sample fabrics obtained by random sampling is observed by using a KEYENCE VHX-2000C microscope. The fabric is placed in such a way that the reverse side is upward. The multiplying factor of the microscope is adjusted as 150 times. The images of the observed place at different depths are combined and subjected to 3D display. The concave-convex height (profile for measurement) in the vertical direction (longitudinal direction of fabric) shown in the 3D picture is measured. In details, the complete convex parabola in the middle area of the concave-convex height curve is selected for conducting the determination, wherein the vertex of the selected parabola is designated as A, and two parallel lines (in vertical direction) respectively at 100 μm of the left and the right side from the vertex (which is set as the center) are plotted. The lowest point of the intersecting points of these two lines with the parabola is designated as B. By plotting two parallel lines respectively along A and B, the distance h from vertex A to the lowest point B is determined. The measurement is repeated respectively at 10 places of the sample fabric according to the aforementioned method. The largest two values and the smallest two values are discarded. The remaining six values are used for average calculation. Thus calculated average is the convex height of the concave-convex structure in the reverse side of the fabric.

(2) Distance Between the Adjacent Convex Parts

A 20 cm*20 cm sample fabrics obtained by random sampling is observed by using a KEYENCE VHX-2000C microscope. The fabric is placed in such a way that the reverse side is upward. The multiplying factor of the microscope is adjusted as 150 times. The images of the observed place under different depths are combined and subjected to 3D display. The distance between adjacent convex parts (profile for measurement) in the vertical direction (longitudinal direction of fabric) shown in the 3D picture is measured. In details, the complete concave parabola between the adjacent convex parts is selected to conduct the determination, wherein the lowest point C of the selected parabola is designated as C, and a horizontal line is plotted 50 50 μm above the lowest point (which is used as a starting point). The distance w between two points where the horizontal line intersects the concave parabola is measured. The measurement is repeated respectively at 10 places of the sample fabric according to the aforementioned method. The largest two values and the smallest two values are discarded. The remaining six values are used for average calculation. Thus calculated average is the distance between adjacent convex parts defined by the present invention.

(3) Water Absorptivity (Drop Falling Method)

Three pieces of sample fabrics of about 15 cm*15 cm are taken and fixed in a face-down way to a frame with a diameter of more than 10 cm under the condition of no-excess tension. The surface of the sample fabric is placed horizontally, and is fixed to the fixture. The front end of the burette is located at 5 cm above the sample fabric surface horizontally placed. The water-absorbent time from dropping of 1 water drop to the time point that special reflection on the test piece disappears when water dropping on the test piece (read to 0.1 seconds). The measurement of water-absorbent time is repeated at arbitrary 3 places to calculate the average.

(4) The Water Retention Rate of Inner Side (Reverse Side), and the Outer/Inner Ratio of Water Retention Rate 3 pieces of sample fabrics of 10 cm*10 cm, 6 pieces of filter paper with the same size and 1 piece of PMMA with the same size are taken for measurement. The weights of PMMA ($W_0$) and sample fabric weight ($W_1$) are weighed under a temperature of 20° C. and a humidity of 65% (with three decimal places).

2 cc of distilled water taken with a syringe are placed onto the PMMA. Immediately after that, the sample fabric is placed on the water and kept for 1 min. The weight of sample fabric after water absorption ($W_2$) is weighed (with three decimal places).

The weights of PMMA after test and the weight of the residual distilled water after test ($W_3$) are weighed (with three decimal places).

Two pieces of filter paper before water absorption (w1, w3) are weighed (with three decimal places).

The sample fabric after the water absorption is placed between the two pieces of filter paper. A weight of 500 g is loaded onto it. After 1 min, the outer filter paper and the inner filter are weighed (w2, w4) (with three decimal places).

The ratio of outer/inner water retention rate is calculated through the following equation (with one decimal place).

$$\text{Outer water retention rate (\%)}=(w2-w1)/(W_2-W_1)\times 100$$

$$\text{Inner water retention rate (\%)}=(w4-w3)/(W_2-W_1)\times 100$$

$$\text{Ratio of outer/inner water retention rate}=\text{Outer water retention rate (\%)}/\text{Inner water retention rate (\%)}$$

$W_0$: Weight of PMMA before water absorption, g;

$W_1$: Weight of sample fabric before water absorption, g;

$W_2$: Weight of sample fabric after water absorption, g;

$W_3$: Weight of PMMA and residual distilled water after water absorption, g;

w1: Weight of outer filter paper before water absorption, g;

w2: Weight of outer filter paper after water absorption, g;

w3: Weight of inner filter paper before water absorption, g;

w4: Weight of inner filter paper after water absorption, g.

(5) Contract Recovery Rate (CR Value)

a. At first, the yarn to be tested was conditioned under standard atmosphere pressure for 12 h.

b. 10 m of the test yarn are taken by a measuring reel (10 cycles*1 m/cycle). The yarn head and tail are knotted, and a color mark line is tied on the yarn for marking. It is hung on the test rack.

c. The skein is placed under standard atmospheric conditions, and subjected to balance for more than 12h before heat treatment.

d. A certain amount of soft water is added to the thermostat and take care to ensure that the sample is completely submerged, and does touch the tank wall. The temperature of the water tank is set at 90° C. The test sample is folded twice, and filled in a mesh bag under relaxed state. The mesh bag containing the test sample is placed into the hot water and stirred uniformly with a glass rod for 20 min. After heat treatment, the mesh bag is removed with a pair of clips, and put into a tray. After the mesh bag is cooled, the test sample is hung loosely and without tension, and subjected to balance after heat treatment in the standard atmosphere.

e. Calculation of the initial load and constant load. Initial load (g): 0.002 g/d×yarn denier (D)×2×(number of turns). Constant load (g): 0.1 g/d×yarn denier (D)×2×(number of turns).

f. One day before the test, a large amount of soft water was added into a large test cylinder, which is kept under standard atmosphere at 20° C. for 12 hours.

g. The test sample is hung with the yarn hook. On the other end, an initial load and a constant load are sequentially hung on the color marking line. The sample is placed into soft water in the large test cylinder with carefully adjusting the tension, while recording the time with a stopwatch. After 2 minutes, the length of the sample (L) is read with a ruler (accurate to 1 mm). After removing the constant load with a hook, the sample is kept with the initial load for 2 minutes, afterwards the length of the sample is measured again (L1) with a ruler (accurate to 1 mm). The calculation equation of the contract recovery rate (i.e., yarn CR value) is:

$$CR=\frac{L-L1}{L}\times 100$$

CR: Contract recovery rate, %;

L: Length of sample under the initial load and the constant load, mm;

L1: Length of sample under the initial load without the constant load, mm.

Example 1

In a 28 G knitting circular knitting machine, cross knitting is performed with 50D-96f-round full dull PET DTY, 75D-

72f-cross/round full dull PET DTY, and 55D-24f-PBT DTY (CR value 49%) and using changing pique as the structure, providing a single-sided knitted grey fabric, wherein the reverse side is the concave-convex structure (the convex height is 86 μm, and the distance between adjacent convex parts is 161 μm), and the fiber in convex parts is PBT. After pretreatment, dyeing (refining agent 1 g/L, disperse dyeing 130° C.*30 min, hydrophilic resin 10 g/L), and after-treatment processing (anti-static agents 1 g/L, neutralization acid 1 g/L), a knitted fabric is obtained.

The respective properties of the obtained fabric are shown in Table 1.

Example 2

In a 28 G knitting circular knitting machine, cross knitting is performed with 60D-72f-round semi-dull PET DTY, 75D-72f-cross section semi-dull PET DTY, and 75D-24f-PBT DTY (CR value 51%) and using changing pique as the structure, providing a single-sided knitted grey fabric wherein the reverse side is the concave-convex structure (the convex height is 94 μm, and the distance between adjacent convex parts is 180 μm), and the fiber in convex parts is PBT. After pretreatment, dyeing (refining agent 1 g/L, disperse dyeing 130° C.*40 min), and after-treatment processing (anti-static agents 2 g/L, neutralization acid 1 g/L, hydrophilic resin 15 g/L), a knitted fabric is obtained.

The respective properties of the obtained fabric are shown in Table 1.

Example 3

In a 32 G knitting circular knitting machine, cross knitting is performed with 50D-96f-cross section semi-dull PET DTY, 50D-48f-PBT DTY (CR value 54%) and using changing pique as the structure, providing a single-sided knitted grey fabric wherein the reverse side is the concave-convex structure (the convex height is 131 μm, and the distance between adjacent convex parts is 137 μm), and the fiber in convex parts is PBT. After pretreatment, dyeing (refining agent 1 g/L, disperse dyeing 130° C.*35 min, hydrophilic resin 5 g/L), and after-treatment processing (anti-static agents 1 g/L, neutralization acid 1 g/L), a knitted fabric is obtained.

The respective properties of the obtained fabric are shown in Table 1.

Example 4

In a 28 G knitting circular knitting machine, cross knitting is performed with 50D-96f-round full dull PET DTY, 30D PU and 75D-36f-PTT/PET DTY (CR value 50%) and using changing pique as the structure, providing a single-sided knitted grey fabric wherein the reverse side is the concave-convex structure (the convex height is 109 μm, and the distance between adjacent convex parts is 216 μm), and the fiber in convex parts is PTT/PET. After pretreatment, dyeing (refining agent 1 g/L, disperse dyeing 130° C.*30 min, hydrophilic resin 10 g/L), and after-treatment processing (anti-static agents 1 g/L, neutralization acid 1 g/L), a knitted fabric is obtained.

The respective properties of the obtained fabric are shown in Table 1.

Example 5

In a 28 G knitting circular knitting machine, cross knitting is performed with 50D-72f-cross section semi-dull PET DTY, 50 polyester-cotton staple yarns and 50D-12f-high viscosity PET/low viscosity PET FDY (CR value 32%) and using changing pique stripes with interlaced thickness as the structure, providing a single-sided knitted grey fabric wherein the reverse side is the concave-convex structure (the convex height is 41 μm, and the distance between adjacent convex parts is 312 μm), and the fiber in convex parts is PET/PET. After pretreatment (refining agent 1 g/L, temperature 90° C.), dyeing (disperse dyeing 125° C.*45 min, hydrophilic resin 10 g/L), and after-treatment processing (anti-static agents 1 g/L, neutralization acid 1 g/L), a knitted fabric is obtained.

The respective properties of the obtained fabric are shown in Table 1.

Example 6

In a 28 G knitting circular knitting machine, cross knitting is performed with 40 cotton staple yarns, and 75D-36f-round high elastic PET DTY (CR value 30%), and using changing pique as the structure, providing a single-sided knitted grey fabric, wherein the reverse side is the concave-convex structure (the convex height is 40 μm, and the distance between adjacent convex parts is 376 μm), and the fiber in convex parts is high elastic PET DTY. After pretreatment (refining agent 1 g/L, bleach 2 g/L, temperature 95° C.), dyeing (reactive dyeing 80° C.*60 min), and after-treatment processing (anti-static agents 1 g/L, neutralization acid 1 g/L), a knitted fabric is obtained.

The respective properties of the obtained fabric are shown in Table 1.

Example 7

In a 28 G knitting circular knitting machine, cross knitting is performed with 40 polyester viscose staple yarns and 50D-24f-PTT/PET FDY (CR value 40%) and using changing pique as the structure, providing a single-sided knitted grey fabric, wherein the reverse side is the concave-convex structure (the convex height is 52 μm, and the distance between adjacent convex parts is 329 μm), and the fiber in convex parts is PTT/PET. After pretreatment (refining agent 1 g/L, temperature 100° C.), dyeing (disperse dyeing 135° C.*25 min), and after-treatment processing (anti-static agents 1 g/L, neutralization acid 1 g/L, hydrophilic resin 15 g/L), a knitted fabric is obtained.

The respective properties of the obtained fabric are shown in Table 1.

Example 8

In a 28 G knitting circular knitting machine, cross knitting is performed with 75D-72f-triangular lustrous PET FDY, 75D-72f-round full dull PET DTY, and 50D-24f-PTT DTY (CR value 31%), and using changing pique stripes as the structure, providing a single-sided knitted grey fabric, wherein the reverse side is the concave-convex structure (the convex height is 41 μm, and the distance between adjacent convex parts is 305 μm), and the fiber in convex parts is PTT. After pretreatment (refining agent 2 g/L, temperature 90° C.), dyeing (disperse dyeing 130° C.*30 min), and after-treatment processing (anti-static agents 1.0 g/L, neutralization acid 1.0 g/L), a knitted fabric is obtained.

The respective properties of the obtained fabric are shown in Table 1.

Example 9

In a 28 G knitting circular knitting machine, cross knitting is performed with 70D-24f-round semi-dull nylon DTY and 75D-48f-PBT/PET DTY (CR value 43%) and using changing pique as the structure, providing a single-sided knitted grey fabric, wherein the reverse side is the concave-convex structure (the convex height is 49 μm, and the distance between adjacent convex parts is 332 μm), and the fiber in convex parts is PBT/PET. After pretreatment, dyeing (refining agent 1 g/L, disperse dyeing 130° C.*30 min, hydrophilic resin 10 g/L), and after-treatment processing (anti-static agents 1.0 g/L, neutralization acid 1.0 g/L), a knitted fabric is obtained.

The respective properties of the obtained fabric are shown in Table 1.

Example 10

In a 28 G knitting circular knitting machine, cross knitting is performed with 40S polyester staple yarns and 50D-48f-PBT DTY (CR value 48%), and using changing pique as the structure, providing a single-sided knitted grey fabric, wherein the reverse side is the concave-convex structure (the convex height is 63 μm, and the distance between adjacent convex parts is 323 μm), and the fiber in convex parts is PBT. After pretreatment, dyeing (refining agent 1 g/L, disperse dyeing 125° C.*30 min), and after-treatment processing (anti-static agents 1 g/L, neutralization acid 1 g/L), a knitted fabric is obtained.

The respective properties of the obtained fabric are shown in Table 1.

Example 11

In a 28 G knitting circular knitting machine, cross knitting is performed with 75D-72f-round full dull PET DTY, 75D-72f-round semi-dull PET DTY, and 50D-48f-PBT DTY (CR value 42%) and using changing pique stripes as the structure, providing a single-sided knitted grey fabric, wherein the reverse side is the concave-convex structure (the convex height is 72 μm, and the distance between adjacent convex parts is 279 μm), and the fiber in convex parts is PBT/PET. After pretreatment (refining agent 1 g/L, temperature 80° C.), dyeing (disperse dyeing 130° C.*30 min, hydrophilic resin 10 g/L), and after-treatment processing (anti-static agents 1 g/L, neutralization acid 1 g/L), a knitted fabric is obtained.

The respective properties of the obtained fabric are shown in Table 1.

Example 12

In a 28 G knitting circular knitting machine, cross knitting is performed with 50D-36f-round semi-dull PET DTY, 75D-36f-cross section/round semi-dull PET DTY, 50D-36f-lustrous triangular PET FDY, and 55D-24f-PBT DTY (CR value 49%) and using changing pique stripes with interlaced thickness as the structure, providing a single-sided knitted grey fabric, wherein the reverse side is the concave-convex structure (the convex height is 70 μm, and the distance between adjacent convex parts is 255 μm), and the fiber in convex parts is PBT. After pretreatment (refining agent 1 g/L, temperature 110° C.), dyeing (disperse dyeing 135° C.*30 min, hydrophilic resin 10 g/L) and after-treatment processing (anti-static agents 1 g/L, neutralization acid 1 g/L), a knitted fabric is obtained.

The respective properties of the obtained fabric are shown in Table 1.

Example 13

In a 28 G knitting circular knitting machine, cross knitting is performed with 63D-72f-circular twitty PET DTY, and 75D-24f-PBT DTY (CR value 51%) and using changing pique as the structure, providing a single-sided knitted grey fabric, wherein the reverse side is the concave-convex structure (the convex height is 66 μm, and the distance between adjacent convex parts is 309 μm), and the fiber in convex parts is PBT. After pretreatment, dyeing (refining agent 1 g/L, disperse dyeing 130° C.*30 min, hydrophilic resin 5 g/L) and after-treatment processing (anti-static agents 1 g/L, neutralization acid 1 g/L), a knitted fabric is obtained.

The respective properties of the obtained fabric are shown in Table 1.

Example 14

In a 32 G knitting circular knitting machine, cross knitting is performed with 30D-36f-round PET DTY, and 50D-24f-PTT/PET DTY (CR value 39%) and using changing pique as the structure, providing a single-sided knitted grey fabric, wherein the reverse side is the concave-convex structure (the convex height is 58 μm, and the distance between adjacent convex parts is 298 μm), and the fiber in convex parts is PTT/PET. After pretreatment, dyeing (refining agent 1 g/L, disperse dyeing 130° C.*30 min) and after-treatment processing (anti-static agents 1 g/L, neutralization acid 1 g/L, hydrophilic resin 15 g/L), a knitted fabric is obtained.

The respective properties of the obtained fabric are shown in Table 1.

Example 15

In a 28 G knitting circular knitting machine, cross knitting is performed with 75D-36f-round full dull PET DTY, 75D-36f-round semi-dull PET DTY, and 50D-48f-PBT/PET DTY (CR value 41%), and using changing pique stripes as the structure, providing a single-sided knitted grey fabric, wherein the reverse side is the concave-convex structure (the convex height is 73 μm, and the distance between adjacent convex parts is 287 μm), and the fiber in convex parts is PBT/PET. After pretreatment (refining agent 1 g/L, temperature 80° C.), dyeing (disperse dyeing 130° C.*30 min, hydrophilic resin 10 g/L) and after-treatment processing (anti-static agents 1 g/L, neutralization acid 1 g/L), a knitted fabric is obtained.

The respective properties of the obtained fabric are shown in Table 1.

Example 16

In a 28 G knitting circular knitting machine, cross knitting is performed with 60D-72f-round PET DTY, 75D-72f-cross section PET DTY, and 75D-36f-high viscosity PET/low viscosity PET FDY (CR value 36%) and using changing pique as the structure, providing a single-sided knitted grey fabric, wherein the reverse side is the concave-convex structure (the convex height is 45 μm, and the distance between adjacent convex parts is 301 μm), and the fiber in convex parts is PET/PET. After pretreatment (refining agent 0.5 g/L, temperature 100° C.), dyeing (disperse dyeing 130° C.*30 min), and after-treatment processing (anti-static agents 1 g/L, neutralization acid 1 g/L, hydrophilic resin 10 g/L), a knitted fabric is obtained.

The respective properties of the obtained fabric are shown in Table 1.

Example 17

In a 28 G knitting circular knitting machine, cross knitting is performed with 75D-72f-round PET DTY, and 75D-24f-

PBT DTY (CR value 49%) and using changing pique as the structure, providing a single-sided knitted grey fabric, wherein the reverse side is the concave-convex structure (the convex height is 72 μm, and the distance between adjacent convex parts is 279 μm), and the fiber in convex parts is PBT. After pretreatment (refining agent 1 g/L, temperature 80° C.), dyeing (disperse dyeing 130° C.*30 min, hydrophilic resin 10 g/L) and after-treatment processing (anti-static agents 1 g/L, neutralization acid 1 g/L), a knitted fabric is obtained.

The respective properties of the obtained fabric are shown in Table 1.

Comparative Example 1

In a 28 G knitting circular knitting machine, cross knitting is performed with 60D-72f-round PET DTY, 75D-72f-cross section PET DTY, and 75D-36f-high viscosity PET/low viscosity PET FDY (CR value 36%) yarns and using ordinary pique as the structure, providing a single-sided knitted grey fabric, wherein the reverse side is not the concave-convex structure. After pretreatment (refining agent 1 g/L, temperature 80° C.), dyeing (disperse dyeing 125° C.*30 min, hydrophilic resin 10 g/L), and after-treatment processing (anti-static agents 1 g/L, neutralization acid 1 g/L), a knitted fabric is obtained.

The respective properties of the obtained fabric are shown in Table 1.

Comparative Example 2

In a 28 G knitting circular knitting machine, cross knitting is performed with 75D-72f-round PET DTY, and 75D-24f-PBT (CR value 49%) DTY yarns and using ordinary pique as the structure, providing a single-sided knitted grey fabric, wherein the reverse side is the concave-convex structure (the convex height is 22 μm, and the distance between adjacent convex parts is 418 μm), and the fiber in convex parts is PBT. After pretreatment (refining agent 1 g/L, temperature 80° C.) dyeing (disperse dyeing 130° C.*30 min, hydrophilic resin 10 g/L) and after-treatment processing (anti-static agents 1 g/L, neutralization acid 1 g/L), a knitted fabric is obtained.

The respective properties of the obtained fabric are shown in Table 1.

Example 18

In a 28 G knitting circular knitting machine, cross knitting is performed with 150D-144f-round semi-dull PET DTY, and 150D-48f-PBT DTY (CR value 46%) and using changing pique as the structure, providing a single-sided knitted grey fabric, wherein the reverse side is the concave-convex structure (the convex height is 81 μm, and the distance between adjacent convex parts is 231 μm), and the fiber in convex parts is PBT. After pretreatment, dyeing (refining agent 1 g/L, disperse dyeing 135° C.*30 min, hydrophilic resin 5 g/L) and after-treatment processing (anti-static agents 1 g/L, neutralization acid 1 g/L), a knitted fabric is obtained.

The respective properties of the obtained fabric are shown in Table 2.

Comparative Example 3

In a 28G double-sided single-sided circular knitting machine, cross knitting is performed with 150D-144f-round semi-dull PET DTY, 150D-48f-PBT DTY (CR value 46%) and using double-sided concave-convex as the structure, providing a double-sided knitted grey fabric, wherein the reverse side is the concave-convex structure (the convex height is 33 μm, and the distance between adjacent convex parts is 329 μm), and the fiber in both parts is PBT. After pretreatment, dyeing (refining agent 1 g/L, disperse dyeing 130° C.*30 min, hydrophilic resin 5 g/L) and after-treatment processing (anti-static agents 1 g/L, neutralization acid 1 g/L), a knitted fabric is obtained.

The respective properties of the obtained fabric are shown in Table 2.

Example 19

In a 28 G knitting circular knitting machine, cross knitting is performed with 75D-72f-round semi-dull PET DTY, and 75D-24f-PBT DTY (CR value 49%) yarns and using changing pique as the structure, providing a single-sided knitted grey fabric, wherein the reverse side is the concave-convex structure (the convex height is 74 μm, and the distance between adjacent convex parts is 129 μm), and the fiber in convex parts is PBT. After pretreatment (refining agent 1 g/L, temperature 90° C.), dyeing (disperse dyeing 130° C.*40 min) and after-treatment processing (anti-static agents 1 g/L, neutralization acid 1 g/L, hydrophilic resin 10 g/L), a knitted fabric is obtained.

The respective properties of the obtained fabric are shown in Table 3.

Comparative Example 4

In a 28 G knitting circular knitting machine, cross knitting is performed with 75D-72f-round semi-dull PET DTY, 75D-24f-round semi-dull PET DTY and using changing pique as the structure, providing a single-sided knitted grey fabric, wherein the reverse side is the concave-convex structure (the convex height is 26 μm, and the distance between adjacent convex parts is 329 μm), and the fiber in convex parts is PET FDY. After pretreatment (refining agent 1 g/L, temperature 80° C.), dyeing (disperse dyeing 130° C.*40 min) and after-treatment processing (anti-static agents 1 g/L, neutralization acid 1 g/L, hydrophilic resin 10 g/L), a knitted fabric is obtained.

The respective properties of the obtained fabric are shown in Table 3.

Comparative Example 5

In a 28 G knitting circular knitting machine, cross knitting is performed with 75D-72f-round semi-dull PET DTY, 70D-24f-round semi-dull round nylon DTY and using changing pique as the structure, providing a single-sided knitted grey fabric, wherein the reverse side is the concave-convex structure (the convex height is 35 μm, and the distance between adjacent convex parts is 397 μm), and the fiber in convex parts is nylon. After pretreatment (refining agent 1 g/L, temperature 80° C.), dyeing (disperse dyeing 120° C.*40 min) and after-treatment processing (anti-static agents 1 g/L, neutralization acid 1 g/L, hydrophilic resin 10 g/L), a knitted fabric is obtained.

The respective properties of the obtained fabric are shown in Table 3.

Comparative Example 6

In a 28 G knitting circular knitting machine, cross knitting is performed with 75D-72f-round semi-dull PET DTY, and 60S cotton staple yarn and using changing pique as the structure, providing a single-sided knitted grey fabric, wherein the reverse side is the concave-convex structure (the convex height is 10 μm, and the distance between adjacent convex parts is 426 μm), and the fiber in convex parts is cotton. After pretreatment (refining agent 1 g/L, temperature 80° C.), dyeing (disperse dyeing 130° C.*30 min) and after-treatment processing (anti-static agents 1 g/L, neutralization acid 1 g/L, hydrophilic resin 10 g/L), a knitted fabric is obtained.

The respective properties of the obtained fabric are shown in Table 3.

Comparative Example 7

In a 28 G knitting circular knitting machine, cross knitting is performed with 75D-72f-round semi-dull PET DTY, 75D-24f-round semi-dull PET DTY (CR value 20%) and using changing pique as the structure, providing a single-sided knitted grey fabric, wherein the reverse side is the concave-convex structure (the convex height is 18 μm, and the distance between adjacent convex parts is 365 μm), and the fiber in convex parts is PET DTY. After pretreatment (refining agent 1 g/L, temperature 80° C.) dyeing (disperse dyeing 130° C.*30 min) and after-treatment processing (anti-static agents 1 g/L, neutralization acid 1 g/L, hydrophilic resin 10 g/L), a knitted fabric is obtained.

The respective properties of the obtained fabric are shown in Table 3.

T-shirts or POLO shirts are made by using the water-absorbent quick-drying knitted fabric described in Examples 1-19.

TABLE 1

| | Concave-convex structure in the reverse side | | | | Yarns used for cross knitting | | |
|---|---|---|---|---|---|---|---|
| | Yes/No | Height of convex part (μm) | Distance between the adjacent convex parts (μm) | Fiber of convex part (CR) | (1) | (2) | (3) |
| Example 1 | Yes | 86 | 161 | PBT (49%) | Round PET | Cross/round PET | |
| Example 2 | Yes | 94 | 180 | PBT (51%) | Round PET | Cross PET | — |
| Example 3 | Yes | 131 | 137 | PBT (54%) | Cross PET | — | — |
| Example 4 | Yes | 109 | 216 | PTT/PET (50%) | Round PET | PU | — |
| Example 5 | Yes | 41 | 312 | PTT/PET (32%) | Cross PET | Polyester-cotton staple yarn | — |
| Example 6 | Yes | 40 | 376 | High elastic PET (30%) | Cotton staple yarn | — | — |
| Example 7 | Yes | 52 | 329 | PTT/PET (40%) | Polyester viscose staple yarn | — | — |
| Example 8 | Yes | 41 | 305 | PTT (31%) | Delta PET | Round PET | — |
| Example 9 | Yes | 49 | 332 | PBT/PET (43%) | Round nylon | — | — |
| Example 10 | Yes | 63 | 323 | PBT (48%) | PET staple yarn | — | — |
| Example 11 | Yes | 72 | 279 | PBT/PET (42%) | Full dull round PET (75D-72f) | Semi-dull round PET (75D-72f) | — |
| Example 12 | Yes | 70 | 255 | PBT (49%) | Round PET | Cross/round PET | Delta PET |
| Example 13 | Yes | 66 | 309 | PBT (51%) | Round PET | — | — |
| Example 14 | Yes | 58 | 298 | PTT/PET (39%) | Round PET | — | — |
| Example 15 | Yes | 73 | 287 | PBT/PET (41%) | Full dull round PET (75D-36f) | Semi-dull round PET (75D-36f) | — |
| Example 16 | Yes | 45 | 301 | PET/PET (36%) | Round PET | Cross PET | — |
| Example 17 | Yes | 72 | 279 | PBT (49%) | Round PET | — | — |
| Comparative Example 1 | No | — | — | — | Round PET | Cross PET | PET/PET |
| Comparative Example 2 | Yes | 22 | 418 | PBT (49%) | Round PET | — | — |

| | Weave | Gram weight (g/m$^2$) | Ratio of outer/inner water retention rate | Inner water retention rate (%) | Water absorptivity (s) |
|---|---|---|---|---|---|
| Example 1 | Changing pique | 125 | 23.0 | 2.7 | No higher than 1 |
| Example 2 | Changing pique | 135 | 25.0 | 2.5 | No higher than 1 |
| Example 3 | Changing pique | 120 | 26.7 | 2.3 | No higher than 1 |
| Example 4 | Changing pique | 130 | 21.3 | 2.8 | No higher than 1 |

TABLE 1-continued

| | | | | | |
|---|---|---|---|---|---|
| Example 5 | Changing pique strips with interlaced, thickness | 162 | 4.1 | 9.5 | No higher than 1 |
| Example 6 | Changing pique | 205 | 2.8 | 15.3 | 6 |
| Example 7 | Changing pique | 189 | 4.0 | 11.1 | No higher than 1 |
| Example 8 | Changing pique stripes | 150 | 5.6 | 7.8 | 2 |
| Example 9 | Changing pique | 149 | 3.8 | 10.6 | No higher than 1 |
| Example 10 | Changing pique | 160 | 4.3 | 8.3 | 3 |
| Example 11 | Changing pique stripes | 130 | 15.1 | 3.8 | No higher than 1 |
| Example 12 | Changing pique strips with interlaced, thickness | 126 | 16.2 | 3.3 | No higher than 1 |
| Example 13 | Changing pique | 132 | 4.9 | 7.7 | No higher than 1 |
| Example 14 | Changing pique | 165 | 8.6 | 4.3 | No higher than 1 |
| Example 15 | Changing pique stripes | 138 | 10.5 | 3.6 | No higher than 1 |
| Example 16 | Changing pique | 130 | 6.2 | 6.3 | No higher than 1 |
| Example 17 | Changing pique | 137 | 11.2 | 4.4 | No higher than 1 |
| Comparative Example 1 | Ordinary pique | 125 | 1.0 | 15.1 | No higher than 1 |
| Comparative Example 2 | Ordinary pique | 135 | 1.1 | 16.4 | No higher than 1 |

Based on Example 1 and Example 10, it can be seen by comparing a fabric made of cross knitted long-fiber yarns with a fabric made of cross knitted short-fiber yarns that the larger the convex height in the reverse side is, the smaller the distance between adjacent convex parts is, the better the quick drying property is (a larger ratio of outer/inner water retention rate, and a smaller inner water retention rate).

Based on Example 2, Example 3, and Example 17, it can be seen that the higher the CR value of the polyester elastic fiber (as the convex fiber) is, the larger the convex height in the reverse side is, and the smaller the distance between adjacent convex parts is, the better the quick drying property is (a larger ratio of outer/inner water retention rate, and a smaller inner water retention rate).

Based on Example 11 and Example 15, it can be seen that the smaller the monofilament fineness of the long fiber forming the cross knitted yarns is, the better the quick drying property of the obtained fabric is (a larger ratio of outer/inner water retention rate, and a smaller inner water retention rate).

Based on Comparative Example 1 and Example 16, Comparative Example 2 and Example 17, it can be seen that when the reverse side of the fabric has no concave-convex structure, or when the convex height of the concave-convex structure is less than 40 μm, the quick drying property is poorer (a smaller ratio of outer/inner water retention rate, and a larger inner water retention rate).

TABLE 2

| | | Concave-convex structure in the reverse side | | | | | | | | | |
|---|---|---|---|---|---|---|---|---|---|---|---|
| | Single sided/ double sided | Yes/ No | Height of convex part (μm) | Distance between the adjacent convex parts (μm) | Fiber of convex part (CR) | Yarns used for cross knitting | Weave | Gram weight ($g/m^2$) | Ratio of outer/inner water retention rate | Inner water retention rate (%) | Water absorptivity (s) |
| Example 18 | Single | Yes | 81 | 231 | PBT (46%) | Round PET | Changing pique | 230 | 16.7 | 3.1 | No higher than 1 |
| Comparative Example 3 | Double | Yes | 33 | 329 | PBT (46%) | Round PET | Double sided concave-convex | 300 | 1.7 | 18.2 | No higher than 1 |

Based on Example 14 and Example 7, and Example 15 and Example 9, it can be seen that when the cross knitted yarns contain no hydroscopic fibers such as viscose or nylon, the quick drying property is relatively better (a larger ratio of outer/inner water retention rate, and a smaller inner water retention rate).

It can be seen from Table 2 that a double sided knitted fabric obtained by using the same yarns has poorer quick-drying property than the single-sided knitted fabric of the present invention (a smaller ratio of outer/inner water retention rate, and a larger inner water retention rate), and has larger gram weight.

TABLE 3

| | Concave-convex structure in the reverse side | | | | | | | | | |
|---|---|---|---|---|---|---|---|---|---|---|
| | Yes/No | Height of convex part (μm) | Distance between the adjacent convex parts (μm) | Fiber of convex part (CR) | Yarns used for cross knitting | Weave | Gram weight ($g/m^2$) | Ratio of outer/inner water retention rate | Inner water retention rate (%) | Water absorptivity (s) |
| Example 19 | Yes | 74 | 129 | PBT (49%) | Round PET | Changing pique | 156 | 26 | 2.2 | No higher than 1 |
| Comparative Example 4 | Yes | 26 | 329 | PET | Round PET | Changing pique | 140 | 1.2 | 14.9 | No higher than 1 |
| Comparative Example 5 | Yes | 35 | 397 | Nylon | Round PET | Changing pique | 146 | 0.8 | 17.7 | No higher than 1 |
| Comparative Example 6 | Yes | 10 | 426 | Cotton | Round PET | Changing pique | 158 | 0.6 | 19.3 | No higher than 1 |
| Comparative Example 7 | Yes | 18 | 365 | PET (20%) | Round PET | Changing pique | 151 | 1.9 | 12.5 | No higher than 1 |

It can be seen from Table 3 that in comparative examples 4, 5, 6, and 7, although the reverse side is the concave-convex structure, because the fiber forming the convex parts is PET FDY (non-elastic PET), PET DTY (non-elastic PET), nylon, or cotton, the convex height in the reverse side cannot reach 40 μm, the quick drying property of the obtained fabric is not ideal (a smaller ratio of outer/inner water retention rate, and a larger inner water retention rate).

The invention claimed is:

1. A water-absorbent quick-drying knitted fabric, wherein said knitted fabric is a single-layer knitted fabric and the reverse side thereof has a concave-convex structure, wherein the height of the convex parts of said concave-convex structure is 40 to 100 μm, and the fiber forming the convex parts is a polyester elastic fiber, wherein the distance between adjacent convex parts in said concave-convex structure is 50-400 μm.

2. The water-absorbent quick-drying knitted fabric according to claim 1 wherein said polyester elastic fiber is selected from a polybutylene terephthalate mono-component fiber, a polytrimethylene terephthalate mono-component fiber, or a composite fiber thereof with polyethylene terephthalate, or a composite fiber of two kinds of polyethylene terephthalate with viscosity difference.

3. The water-absorbent quick-drying knitted fabric according to claim 1, wherein in said knitted fabric, a yarn, cross-knitted with the polyester elastic fiber that forms the convex parts, includes at least ordinary polyethylene terephthalate fiber.

4. The water-absorbent quick-drying knitted fabric according to claim 1 wherein the gram weight of said knitted fabric is 50 to 250 $g/m^2$.

5. The water-absorbent quick-drying knitted fabric according to claim 1 wherein the ratio of outer/inner water retention rate of said knitted fabric is 5.0 or more.

6. A T-shirt or a polo shirt made with the water-absorbent quick-drying knitted fabric according to claim 1.

* * * * *